US007472632B2

(12) United States Patent
Engvall et al.

(10) Patent No.: US 7,472,632 B2
(45) Date of Patent: Jan. 6, 2009

(54) LOCKING PLIERS

(75) Inventors: David P. Engvall, Stanley, NC (US); Thomas M. Chervenak, Stanley, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 0 days.

(21) Appl. No.: 11/748,764

(22) Filed: May 15, 2007

(65) Prior Publication Data

US 2008/0282851 A1 Nov. 20, 2008

(51) Int. Cl.
*B25B 7/12* (2006.01)

(52) U.S. Cl. ..... 81/370; 81/377

(58) Field of Classification Search ..... 81/367, 81/368, 370, 369, 375, 377–383
See application file for complete search history.

(56) References Cited

U.S. PATENT DOCUMENTS

| | | | | | |
|---|---|---|---|---|---|
| 2,514,130 | A * | 7/1950 | Jones | ..... | 81/370 |
| 2,711,663 | A * | 6/1955 | Petersen | ..... | 81/370 |
| 2,894,547 | A | 7/1959 | Lampe | | |
| 2,966,818 | A | 1/1961 | Froeschl | | |
| 3,496,808 | A * | 2/1970 | Schmidt | ..... | 81/370 |
| 3,657,949 | A * | 4/1972 | Myers | ..... | 81/370 |
| 4,499,797 | A * | 2/1985 | Wilson | ..... | 81/367 |
| 5,056,385 | A | 10/1991 | Petersen | | |
| 5,351,585 | A | 10/1994 | Leseberg et al. | | |
| 5,456,144 | A | 10/1995 | Dahl et al. | | |
| 5,503,049 | A | 4/1996 | Chervenak et al. | | |
| 6,626,070 | B2 | 9/2003 | Peperkorn et al. | | |
| 6,857,342 | B2 * | 2/2005 | Wang | ..... | 81/368 |
| 2004/0055429 | A1 * | 3/2004 | Winkler | ..... | 81/367 |

OTHER PUBLICATIONS

Prothero, Gareth, UK Intellectual Property Office, International Search Report, Aug. 12, 2008.

* cited by examiner

*Primary Examiner*—David B Thomas
(74) *Attorney, Agent, or Firm*—Dennis J. Williamson; Moore & VanAllen, PLLC

(57) ABSTRACT

The locking pliers comprises a first handle connected to a first jaw. A second handle and second jaw are pivotably connected to the first handle and first jaw such that movement of the first handle relative to the second handle causes the jaws to open and close. A mechanism is provided to lock the jaws relative to one another and apply a clamping or gripping force on a workpiece positioned between the jaws. A release mechanism is provided to unlock the pliers that is independent of the locking operation.

9 Claims, 5 Drawing Sheets

LOCKING PLIERS

BACKGROUND

This invention relates generally to locking pliers and, more particularly, to an improved release mechanism for such pliers.

Pliers-type hand tools with toggle-locking mechanisms are generally known as locking pliers. These pliers usually comprise a fixed handle having a fixed jaw on one end thereof. A movable jaw and a movable handle are pivotal relative to the fixed handle to open and close the jaws. To operate the pliers the movable handle is closed relative to the fixed handle to close the jaws and seize a workpiece firmly therebetween. The handles are then tightly compressed such that the toggle mechanism locks the pliers onto the workpiece. The pliers will remain firmly locked in place without the continuous application of force by the user.

The pliers may comprise a relatively simple toggle-locking mechanism where a single link has one end pivotably connected to the movable jaw and the opposite end adjustably and pivotably received in the movable handle such as shown in U.S. Pat. No. 4,546,680. The pliers may also comprise a more complex toggle-locking mechanism that uses a compound linkage where multiple links are pivotably connected to one another between the fixed handle and the movable handle such as shown in U.S. Pat. No. 5,056,385. The locking pliers may also comprise self-adjusting pliers such as shown in U.S. Pat. No. 6,941,844. Other embodiments of locking pliers are also known.

Adjustments in the force applied by the jaws to the workpiece are generally made by turning an adjusting screw mounted in the fixed handle that engages the toggle locking mechanism. The adjusting screw is translated relative to the fixed handle to modify the physical dimensions of the toggle mechanism. This adjustment varies the distance between the jaws and varies the force applied by the jaws to the workpiece when the tool is locked. In certain applications the forces on the pliers can be very high.

Because an over-center locking mechanism is used, once the pliers are locked in position they cannot be opened by a force applied to the jaws. The pliers can only be released by a force applied to the links of the locking mechanism. This may be accomplished by pulling the ends of the handles apart from one another. If the locking force is great, a significant force must be applied to separate the handles and open the pliers. To make opening the pliers easier a release mechanism has been developed. The release mechanism typically comprises a lever pivotably connected to the movable handle at a pivot pin such that the first end of the lever is disposed between and is contacted by a link of the locking mechanism and the fixed handle when the jaws are in the closed and locked position. By pushing on the opposite end of the lever, the lever pivots about the pivot pin forcing the first end of the lever away from the handle to release the locking mechanism.

One problem with such an arrangement is that because the release lever is disposed between the handle and a link of the locking mechanism, the dimensions and configuration of the release lever and its location within the handle changes the geometry of the locking mechanism. A change in the geometry of the locking mechanism changes the locking characteristics of the pliers. As a result it is necessary that the dimensions and configuration of the release lever, its location in the handle and its engagement with the locking mechanism must be carefully controlled during manufacture of the wrench. The controls required during manufacture and assembly of these components increase the cost and complexity of manufacturing of the wrench.

Thus, an improved locking mechanism for locking pliers is desired.

SUMMARY OF THE INVENTION

The locking pliers comprises a first handle connected to a first jaw. A second handle and second jaw are pivotably connected to the first handle and first jaw such that movement of the first handle relative to the second handle causes the jaws to open and close. A mechanism is provided to lock the jaws relative to one another and apply a clamping or gripping force on a workpiece positioned between the jaws. A release mechanism is provided to unlock the pliers that is independent of the locking operation.

DETAILED DESCRIPTION OF EMBODIMENTS OF THE INVENTION

Figure 1:
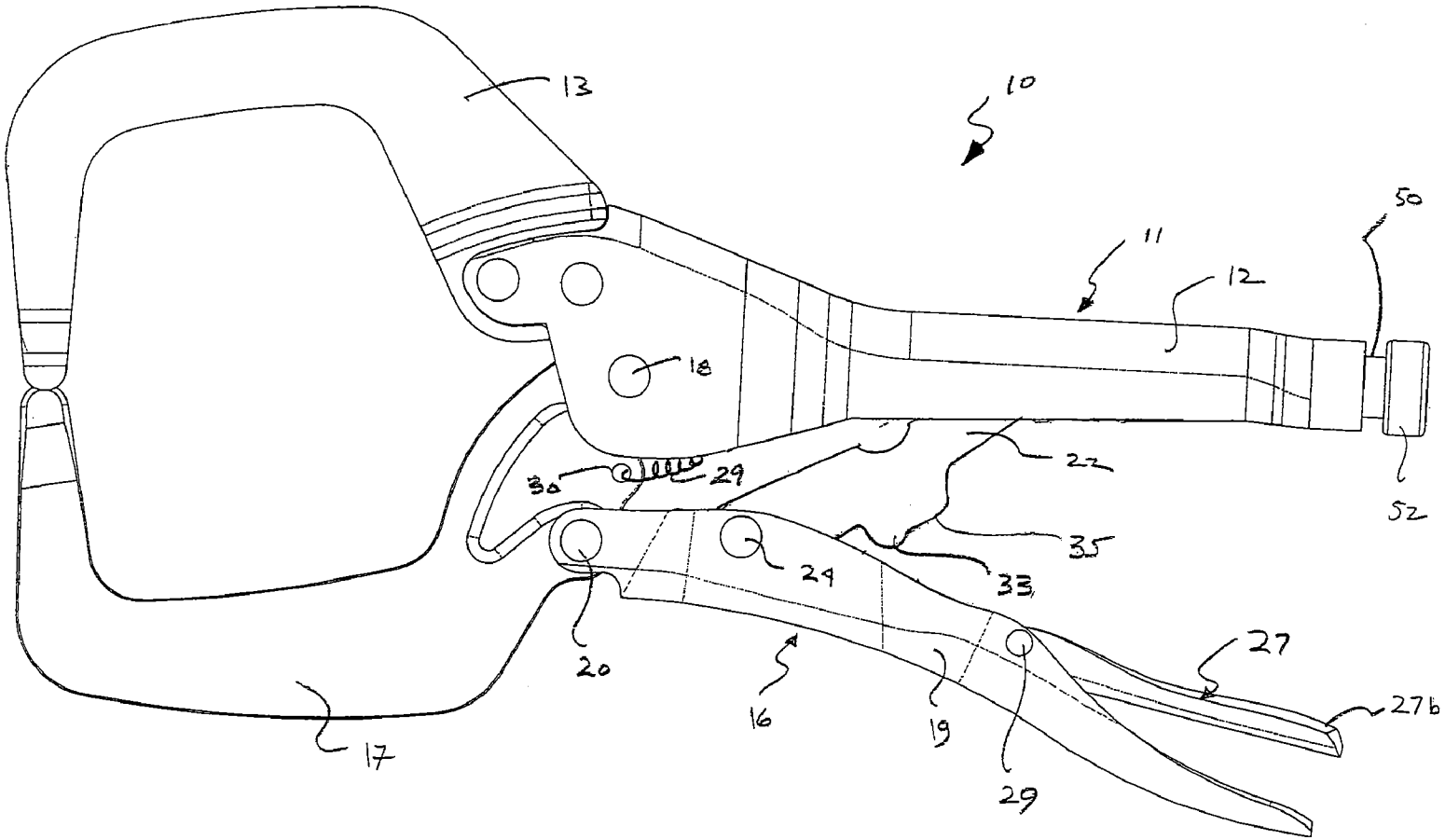
FIG. 1 is a side view of one embodiment of a locking pliers according to the present invention.
Figure 2:
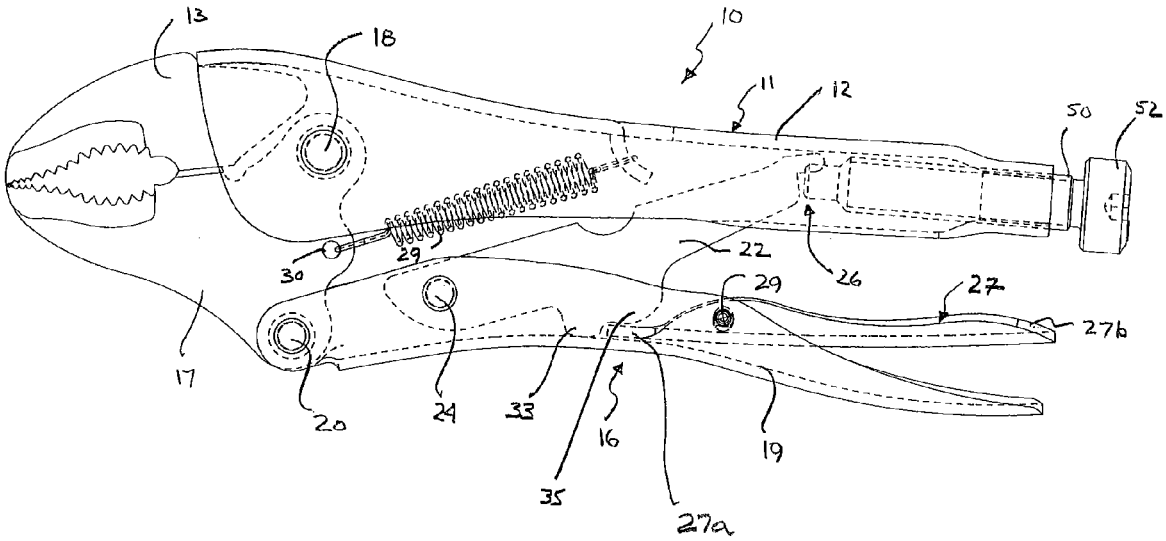
FIG. 2 is a side view of one embodiment of a locking pliers in a locked position.
Figure 3:
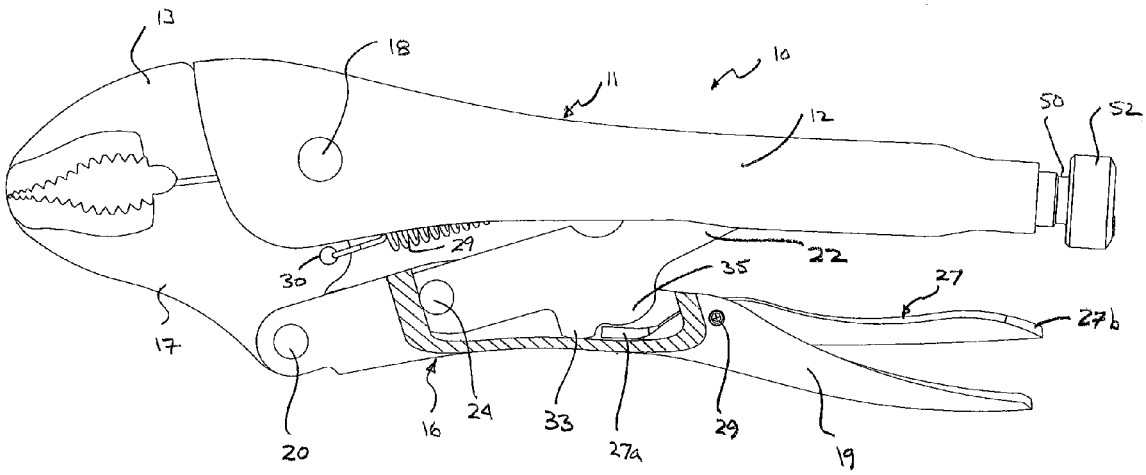
FIG. 3 is a partial cut-away side view of the release mechanism.
Figure 4:
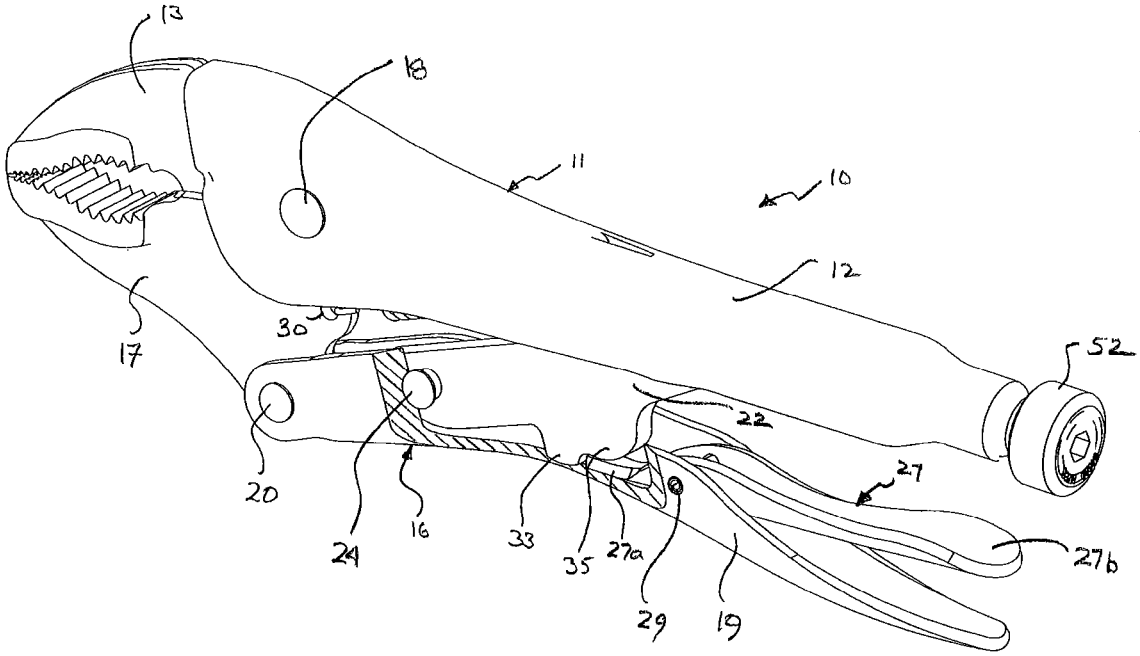
FIG. 4 is a partial cut-away perspective view of the release mechanism.
Figure 5:
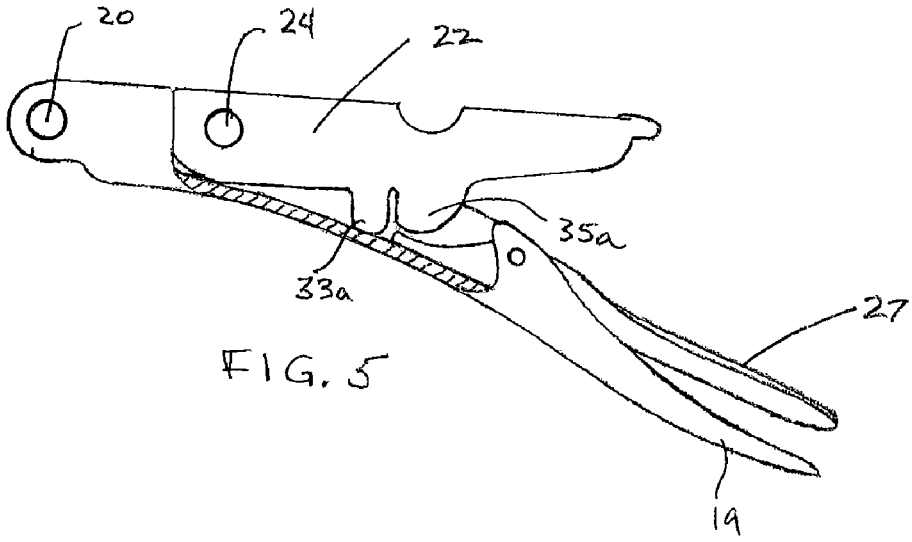
FIG. 5 is a side view of another embodiment of the release mechanism.

The release mechanism of the invention is intended to be used with any locking pliers that use a linkage to lock the jaws in position and apply the clamping force by the jaws to a work piece including simple toggle-locking mechanisms, compound toggle-locking mechanisms and self-adjusting locking pliers. Various configurations of the toggle locking mechanisms, jaws and handles may be used in conjunction with the release mechanism of the invention. The jaws may be shaped to function as long nose pliers, pliers with curved jaws, serrated jaws, C-clamps, C-clamps with swivel pads, hole punches, or any other kind of hand tool where the toggle-locking action is useful. The embodiment of the pliers shown in FIG. 1 shows clamp jaws and the embodiment of the pliers shown in FIGS. 2 through 4 show traditional pliers jaws.

For purposes of explaining the construction and operation of the adjustment mechanism of the invention, one such locking pliers 10 will be described in detail with reference to the figures. Pliers 10 include a fixed arm 11 having a fixed handle 12 at one end and a fixed jaw 13 at the other end. A movable arm 16 includes a movable handle 19 and a movable jaw 17. Movable jaw 17 is pivotably connected to the movable handle 19 by pivot pin 20. A pivot pin 18 connects the movable jaw 17 to the fixed arm 11. A link 22 is pivotably connected to the movable arm 16 by pivot pin 24. As best shown in FIG. 2 the opposite end of link 22 is pivotably supported in fixed arm 11 at pivot 26. The end of link 22 abuts the end of screw 50 such that as screw 50 is translated in arm 11 the end of link 22 is also translated in arm 11. Link 22 is free to pivot relative to screw 50 and arm 11 such that the abutting engagement of link 22 with screw 50 creates a pivot.

While a simple toggle-locking mechanism comprising a single-link 22 is shown, it is to be understood that the toggle-locking mechanism may comprise other configurations including compound toggle-linking mechanisms and/or self-adjusting mechanisms. A biasing spring 29 extends from a hole 30 on the movable jaw 17 to the fixed arm 11. The spring 29 applies a bias which tends to separate the handles 12 and 19 from one another and open jaws 13 and 17.

When the jaws 13 and 17 are in the open position, the pivot points, 18, 20, 24 and 26 are arranged as a polygon. When the jaws are in the closed, locked position as shown in FIG. 2, the pivots 20, 24 and 26 are substantially in a straight line where pin 24 is slightly over-center, toward fixed arm 11, of a line between pivots 20 and 26. The link 22 is prevented from moving closer to the fixed handle 12 because the stop 33 of link 22 presses against the arm 16.

The "throw" of the linkage is the distance the linkage moves from the unlocked position to the locked over-center clamping position. When the work piece is clamped between the jaws and increasing force is applied to the handles 12 and 19, the forces generated on the linkage cause link 22 to pivot and the linkage begins to straighten and the effective length of the linkage between pivots 20 and 26 increases. As the effective length of the linkage increases, increasing force must be applied to the handles 12 and 19 to move the linkage to the over-center locked position. This force is transmitted through the pliers to the work piece to increase the clamping force generated by the jaws on the work piece. Typically, the greater the throw the greater the force applied by the pliers.

It should be further understood that the "over-center" condition of the pivots 20, 24 and 26, which maintains the jaws in a locked position, also includes an arrangement where pins 20, 24 and 26 are aligned "dead center," that is, in a straight line. Any configuration of pivot pins and stops, for example, the stop 33, which places the mechanism in a locked position when the jaws are closed or grasping a workpiece, can be considered an over-center mechanism when force applied directly to the jaws to separate the jaws is not effective in moving the jaws and the jaws can only be opened by forces acting on the links of the mechanism.

Screw 50 is located in the fixed handle such that the longitudinal axis of the screw is disposed along and located in the fixed arm 11. The screw 50 is formed with an enlarged head 52 that can be manually rotated to adjust the locking pliers. The screw is operatively connected to the end of linkage 22 to create pivot 26 such that it can be used to control the effective length of the linkage and thereby the force applied by the pliers in the locked position.

Once locked, the jaws 13 and 17 cannot be pried apart from the locked position by a force acting on the jaws 13, 17 because separation of the jaws is prevented by the over-center condition of the pivots 20, 24 and 26. However, the jaws 13, 17 may be separated by applying a force to the movable handle 19 in a direction which moves the movable handle 19 away from the fixed handle 12. Depending on the amount of force generated through the pliers in the locked position, the force applied to the handles to open the pliers may be relatively large.

A release mechanism is provided to facilitate opening of the jaws. Specifically, lever 27 is pivotably connected to arm 16 at pivot pin 29. As previously explained stop 33 directly contacts the movable arm 16 to limit the movement of the linkage in the locked position. The end 27*a* of lever 27 is disposed between link 22 and movable arm 16 when the jaws are in the closed and locked position but the link 22 does not contact stop 33. Because the movement of the linkage is limited by direct contact between the arm 16 and the link 22 the lever 27 does not affect the throw of the tool.

The end 27*a* of lever 27 cooperates with protrusion 35 to release the jaws. Specifically, in the locked position the end 27*a* of lever 27 is disposed between the protrusion 35 and the movable arm 16 but the lever 27 is not trapped between these elements such that the lever 27 may move slightly between the protrusion 35 and arm 16. Thus, lever 27 has no affect on the stop or locked position of link 22 and therefore has no effect on the clamping force exerted by the jaws 13 and 17. The stop position of link 22 and the locked position of the pliers are controlled by the engagement of stop 33 with arm 16.

By pushing on the opposite end 27*b* of lever 27, lever 27 pivots about pivot pin 29 forcing end 27*a* away from handle 19 to contact link 22 at protrusion 35. The force exerted by lever 27 on protrusion 35 is sufficient to move link 22 and release the locking mechanism.

The pliers discussed with reference to the Figures use a push type release lever where one end of the lever is pushed toward the handle 19 to force the opposite end of the lever into engagement with the link 22. The locking mechanism of the invention may also be used with pull type release levers where the lever is pulled away from handle 19 and into engagement with link 22.

Figure 6:
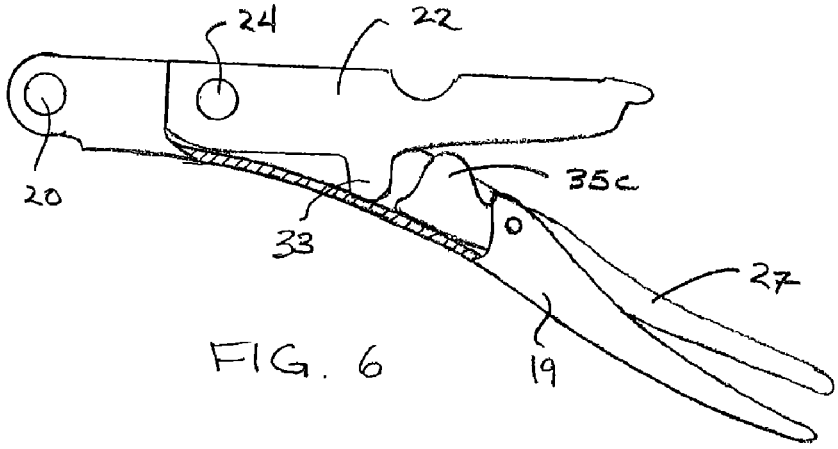
FIG. 6 is a side view of yet another embodiment of the release mechanism.

In the embodiment shown in FIGS. 1 through 5 the stop 33 and protrusion 35 are formed on link 22 closely adjacent one another such that a single continuous projection extends from link 22. In an alternate embodiment the stop 33*a* and the protrusion 35*a* may be separated in distance such that two projections are formed on link 22 as shown in FIG. 6. Further, while the protrusion 35 and stop 33 as shown as being formed integrally with link 22, these elements may be formed as separate components that are attached to link 22. Finally, the protrusion 35*c* may be formed on the lever 27 rather than on link 22 a shown in FIG. 7.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A lockable pliers comprising:

a first handle supporting a first jaw;

a second handle movable relative to the first handle between an open position and a closed, locked position;

a second jaw movable between a first position when said second handle is in said open position and a second position when said second handle is in said closed position;

a locking mechanism having a link for locking the second jaw in the second position;

a stop formed on said link for engaging the second handle and limiting movement of the locking mechanism relative to said second handle when the second handle is in the closed, locked position; and a release lever pivotably connected to said second handle and including a portion located in a space between said locking mechanism and said second handle, said release lever and said space being dimensioned such that the portion of the release lever is not trapped between said second handle and said locking mechanism such that said release lever may move slightly between said second handle and said locking mechanism when said second handle is in the closed, locked position.

2. The locking pliers of claim 1 wherein an adjustment screw changes the geometry of the locking mechanism.

3. The locking pliers of claim 1 wherein a protrusion is formed on said link for being contacted by said release lever.

4. The locking pliers of claim 3 wherein said protrusion is separate from said stop.

5. The locking pliers of claim 4 wherein said protrusion forms a single projection with said stop.

6. The locking pliers of claim 5 wherein said stop extends from said link a greater distance than said protrusion.

7. The locking pliers of claim 4 wherein the protrusion extends from said release lever.

8. A method of making a lockable pliers comprising:

providing a first handle supporting a first jaw;

providing a second handle movable relative to the first handle between an open position and a closed, locked position and a second jaw movable between a first position when said second handle is in said open position and a second position when said second handle is in said closed position;

providing a locking mechanism having a link for locking the second jaw in the second position;

forming a stop on said link for engaging the second handle and limiting the movement of the locking mechanism relative to the second handle when the second handle is in the closed, locked position;

pivotably mounting a release lever on said second handle such that a portion of the release member is located in a space between said locking mechanism and said second handle, dimensioning said release lever and said space such that the portion of the release level is not trapped between said second handle and said locking mechanism such that said release lever may move slightly between said second handle and said locking mechanism when said second handle is in the closed, locked position.

9. A lockable pliers comprising:

a first handle supporting a first jaw;

a second handle movable relative to the first handle between an open position and a closed, locked position;

a second jaw movable between a first position when said second handle is in said open position and a second position when said second handle is in said closed position;

a locking mechanism having a link for locking the second jaw in the second position;

a stop formed on said second handle for engaging the link and limiting movement of the locking mechanism relative to said second handle when the second handle is in the closed, locked position; and a release lever pivotably connected to said second handle and including a portion located in a space between said locking mechanism and said second handle, said release lever and said space being dimensioned such that the portion of the release lever is not trapped between said second handle and said locking mechanism such that said release lever may move slightly between said second handle and said locking mechanism when said second handle is in the closed, locked position.

* * * * *